United States Patent [19]

Wilkinson

[11] Patent Number: 4,665,665

[45] Date of Patent: May 19, 1987

[54] BUILDING STRUCTURE

[76] Inventor: Don G. Wilkinson, 32 Palm Ave., Sarasota, Fla. 33577

[21] Appl. No.: 714,397

[22] Filed: Mar. 21, 1985

[51] Int. Cl.[4] ..... E04B 1/32

[52] U.S. Cl. ..... 52/82; 52/81; 52/DIG. 10

[58] Field of Search ..... 52/80, 81, 82, DIG. 10

[56] References Cited

U.S. PATENT DOCUMENTS

| | | | |
|---|---|---|---|
| 3,977,138 | 8/1976 | Chastain | 52/DIG. 10 |
| 4,048,770 | 9/1977 | McKenzie, III | 52/81 |
| 4,263,758 | 4/1981 | Seaich | 52/DIG. 10 |
| 4,413,452 | 11/1983 | Wilkinson | 52/80 X |
| 4,425,740 | 1/1984 | Golden | 52/DIG. 10 |

OTHER PUBLICATIONS

Domebook II, ©1971, pp. 56, 109, 117.

*Primary Examiner*—William F. Pate, III
*Assistant Examiner*—R. Chilcot
*Attorney, Agent, or Firm*—Charles J. Prescott; Raymond H. Quist

[57] ABSTRACT

A building structure is formed using four by eight foot plywood panels as raw material because of their ready availability. Hexagonal pyramids are formed by first cutting a panel diagonally to form two right triangles. These two right triangles are joined to form a triangular section having a height equal to its base. Six such sections are joined to form the hexagonal pyramids. Pentagonal pyramids are formed by cutting the panels using the eight foot lengths as the dimension of the hypotenuse. Each panel can produce two triangles and they are combined to form an equilateral triangular section. Five of these sections are combined to form each pentagonal pyramid. Reinforcement pyramids are joined in the interior of each pyramid. These are similar to the pyramids they reinforce, but of one half the size. The pyramids are combined using them as substitutes for the plane hexagonal and pentagonal surfaces of regular and semi-regular polyhedrons. These polyhedrons are simple in form and the use of the easily formed pyramids in producing the building structures requires no mathematics or sophisticated tools.

6 Claims, 13 Drawing Figures

BUILDING STRUCTURE

BACKGROUND OF THE INVENTION

1. Field of the Invention

This invention relates generally to a building structure, and more particularly to a structure which can be fabricated from readily available building materials with a minimum of measurement and with unsophisticated tools.

2. Description of the Prior Art

Most modern buildings evolve by first deciding upon floor plans and facades, and then choosing and forming the materials with which the buildings are to be fabricated. This approach is satisfactory in situations where design is an important factor, but is not usually the most economical or uncomplicated approach. Previously I have taken the approach of beginning with readily available building materials and developing a design in which these materials may be assembled into a building structure without requiring any complicated calculations, measurements or tools. Of course the usual requirements of strength, weather resistance and rigidity were also met. Briefly, four foot by eight foot plywood panels are used in this structure by cutting them diagonally and joining the two triangular pieces into an isosceles triangle having an eight foot base and height. These triangles are then assembled into a building structure using adhesive and staples. U.S. Pat. No. 4,413,452 describes this structure.

The foregoing structure eminently met my requirements and gave me the challenge of conceiving a larger structure which would adhere to the same principles of forming complex structures in space using only simple whole numbers and stock four foot by eight foot plywood for components.

Only five regular polyhedrons can be formed, i.e. those having identical sides with identical edges. With the exception of the cube and dodecahedron, the others are composed of equilateral triangles. By joining regular plane figures of more than one type, while keeping the corners or vertices the same, fourteen semiregular polyhedrons can be formed. These regular and semiregular polyhedrons are intuitively attractive as building structures because of their simplicity and symmetry; however, with the well recognized exception of the cube, they have not become popular as building structures.

Others have previously used triangular panels or ribs in fabricating large building structures. These structures have not satified my requirements as one can see by examination. For example, U.S. Pat. No. 3,114,176 discloses a construction which involves fashioning wood frames for triangles and covering them with sheets of plywood, plastic, etc. As the various drawings show, the frames must be measured and cut to various dimensions and assembled using metal fittings.

Another aspect of previous work involves geodesic domes which require a multiplicity of types of components. This approach and the others have resulted in perversions of the simple beauty of the regular and semiregular polyhedrons.

It is therefore an object of my invention, to provide building structures which provide the symmetry of regular and semiregular polyhedrons and still retain the simplicity of construction exemplified in my previously patented invention (U.S. Pat. No. 4,413,452).

SUMMARY OF THE INVENTION

Hexagonal and pentagonal pyramids are used as wall elements in building structures. The hexagonal pyramids are formed from isosceles triangular sections produced by cutting right quadrilateral panels diagonally and joining the two right triangular parts thus formed. The pentagonal pyramids are formed from equilateral triangular sections produced by cutting right quadrilateral panels (of the same size as those used in the hexagonal pyramids) to have the base of the panel and the sides equal.

DETAILED DESCRIPTION OF THE INVENTION

Figure 1:
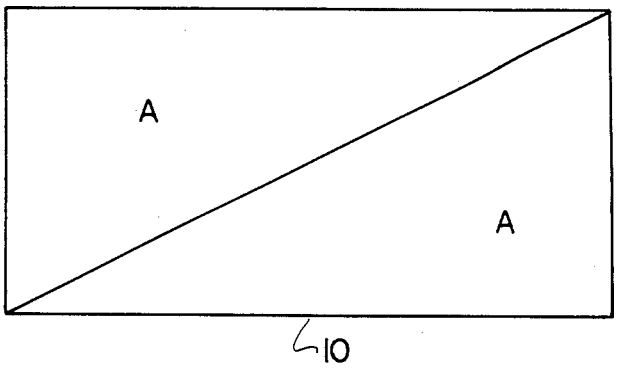
FIG. 1 shows a rectangular panel marked to show a diagonal cut line to form two right triangular sections.

Referring to FIG. 1, rectangular panel 10 is shown having a diagonal line on which it is to be cut into two equal right triangles identified with the letter "A". Rectangular panel 10 is shown as having one side twice as long as the other. This is not an absolute requirement although the sides should be close to a two to one relationship in order to realize the advantages of the invention. It is necessary, however, that rectangular panel 10 be easily available and be substantially rigid. Four foot by eight foot sheets of $\frac{1}{2}$ inch or $\frac{3}{4}$ inch plywood meet this requirement in many places.

Figure 2:
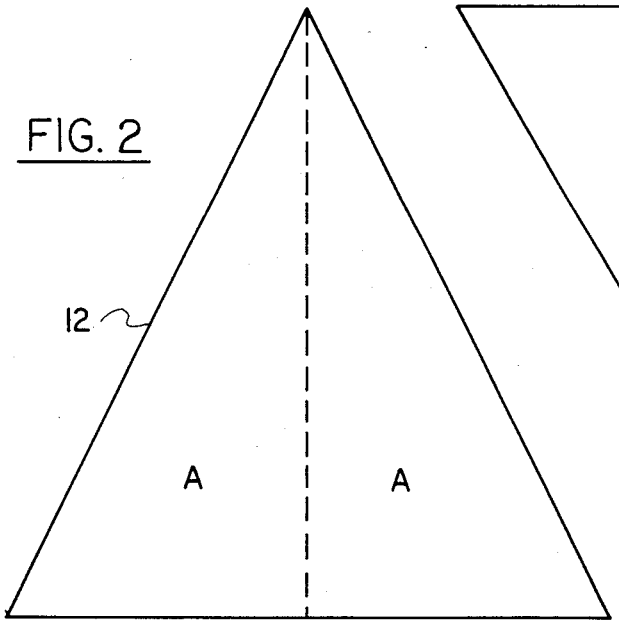
FIG. 2 shows an isosceles triangular panel formed from the sections of FIG. 1.

FIG. 2 shows the two equal right triangles A of FIG. 1 arranged to form isosceles triangle 12. The two pieces may be joined using adhesives, staples, etc.

Figure 3:
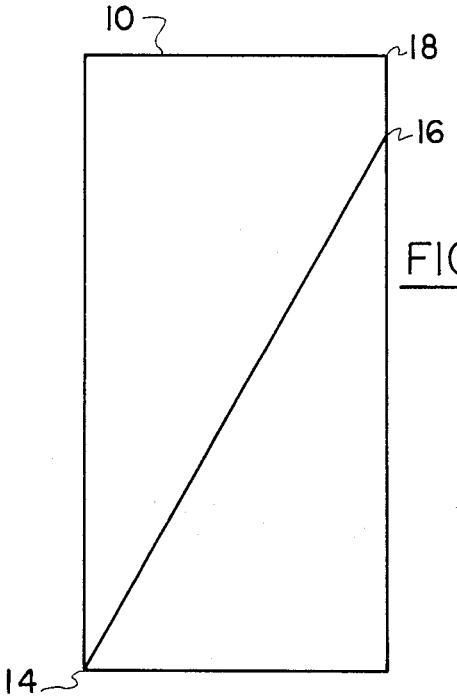
FIG. 3 shows a method for describing a right triangular section for forming an equilateral triangular panel.

FIG. 3 shows panel 10 of the same type as in FIG. 1 with a line described on it extending from corner 14 to a point 16. Line 14–16 is equal to the length of the long side of the panel and point 16 can be located using a string or board of the proper length. In a similar manner a second line may be described on the panel to produce two equal right triangles.

Figure 4:
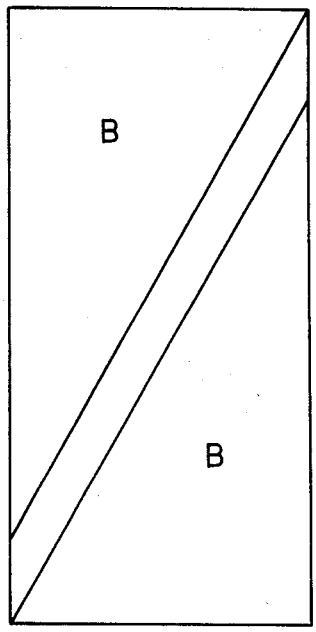
FIG. 4 shows two such right triangular sections described on a single rectangular panel.
Figure 5:
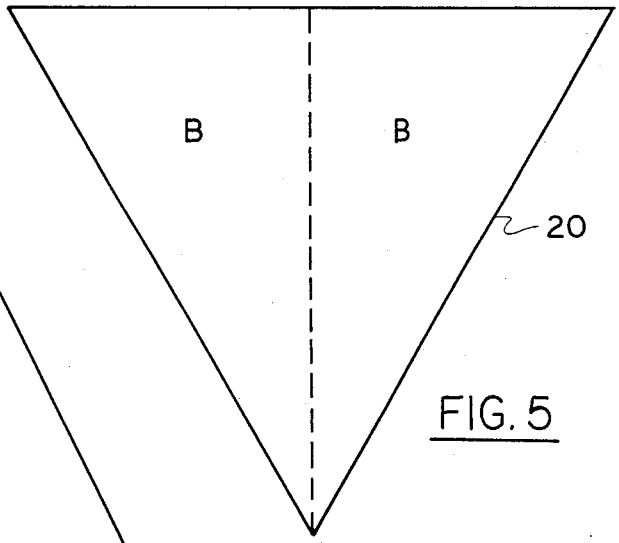
FIG. 5 shows an equilateral triangular panel formed form the sections of FIG. 4.

FIG. 4 shows the panel of FIG. 3 with the two right triangles "B" described on it and FIG. 5 shows the two right triangles "B" joined (as were triangles "A") to form triangle 20. Triangle 20 it will be noted is an equilateral triangle with each edge the same length as the base of triangle 12.

It will be noted that the panels, a scribe and a saw are all that is required in the way of tools to produce the right triangles used.

Figure 6:
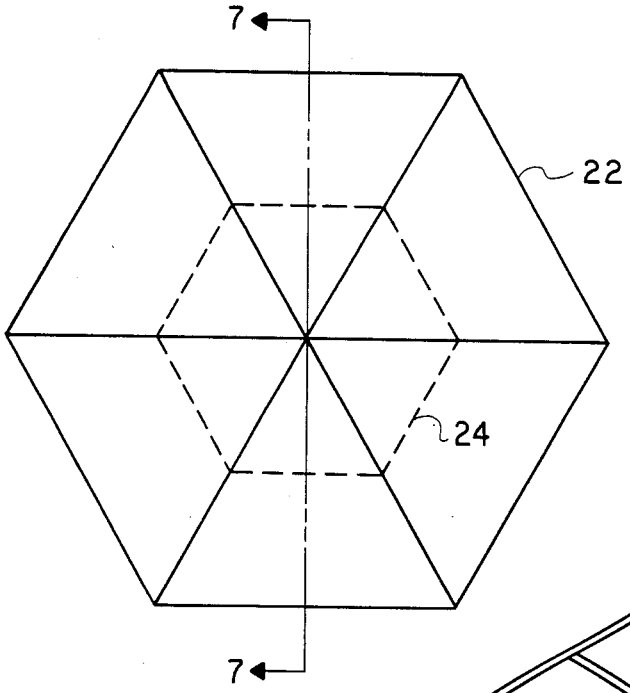
FIG. 6 shows a plan view of a right hexagonal pyramid formed from the isosceles triangular panels of FIG. 2.
Figure 7:
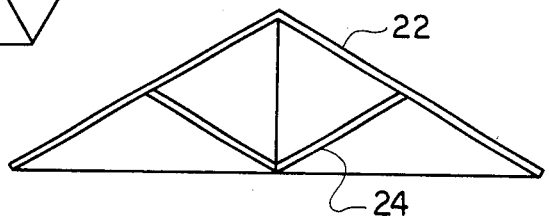
FIG. 7 shows the pyramid of FIG. 6 in a cross-sectional elevation.

Referring next to FIG. 6, triangular panels of the type shown in FIG. 2 are illustrated assembled into hexagonal pyramid 22. As indicated by the broken line in FIG. 6, a similar hexagonal pyramid 24 is joined to the underside of pyramid 22 to reinforce it. Hexagonal pyramid 24 is conveniently made to be one half the size of hexagonal pyramid 22 and forms a truss-like support. If one uses a panel 10 such as in FIG. 1, it would first be cut into four equal rectangles, each of which would then be cut diagonally to form two right triangles as previously described. Pyramid 22 is shown in cross-section in FIG. 7.

Figure 8:
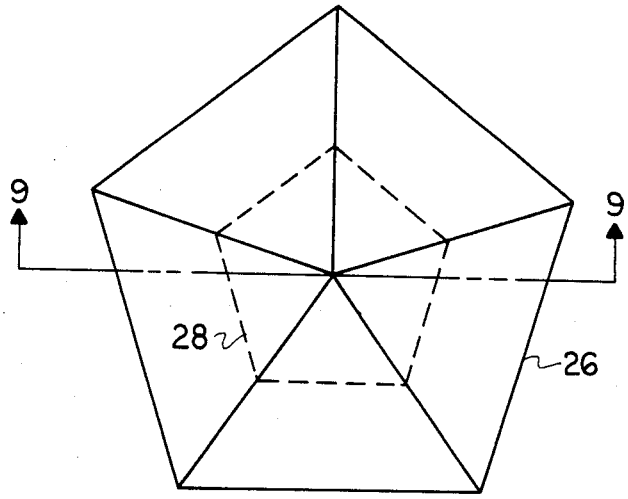
FIG. 8 shows a plan view of a right pentagonal pyramid formed from the equilateral triangular panels of FIG. 5.
Figure 9:
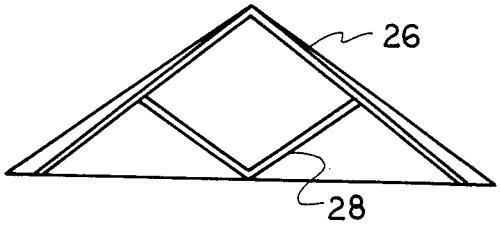
FIG.9 shows the pyramid of FIG. 8 in a cross-sectional elevation.

FIG. 8 represents a pentagonal pyramid 26 which has been assembled from triangular panels of the type shown in FIG. 5. Pyramid 26 also has a similar reinforcing pyramid 28 of one half the size of pyramid 26. FIG. 9 shows the pyramid of FIG. 8 in cross-section.

The hexagonal and pentagonal pyramids described above are but components for larger structures. I choose to call them wall elements and if they are visualized as plane hexagons and pentagons having dimensions equal to those of their bases (as they appear in FIGS. 6 and 8) it is evident that these hexagonal and pentagonal pyramids may be substituted for the plane hexagons and pentagons of the regular and semiregular polyhedrons referred to previously; such as the truncated icosahedron, the dodecahedron and the truncated octahedron.

Figure 10:
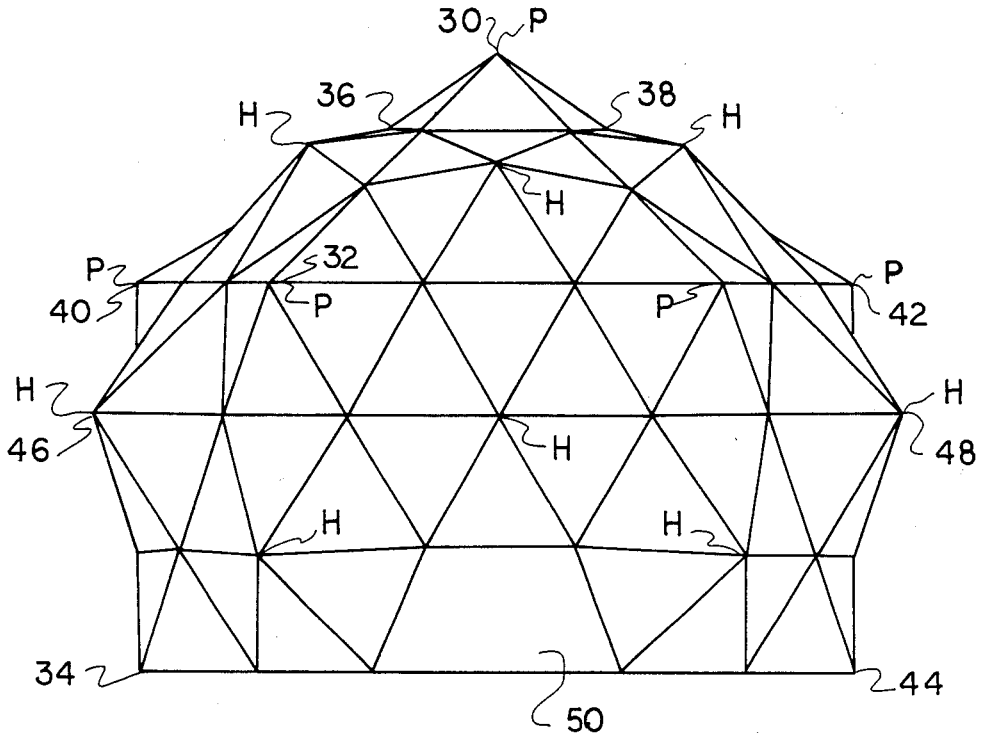
FIG. 10 shows a building structure having the pyramids of FIGS. 6 and 8 as wall elements.

Referring now to FIG. 10, a building structure is shown in which the wall elements are the hexagonal and pentagonal periods previously described. The vertex of each hexagonal pyramid has been labeled "H", and that of each pentagonal pyramid had been labeled "P". If the pattern of pyramids had been completed to form a polyhedron there would have been 20 hexagonal pyramids and 12 pentagonal pyramids. There are some locations where a plane will pass through along cleaveage lines formed by the joining of pyramids or the triangular panels of which they are formed. Such a location is defined by points 30, 32 and 34. Others are along the lines connecting points 36 and 38; 40 and 42; and 34 and 44. The line connecting points 46 and 48 is not such a cleaveage line. Such cleavage lines are preferred locations for the base of the building structure assuming a level foundation is contemplated. In the building structure shown in FIG. 10, I have chosen to have a pentagonal pyramid at the top. With this orientation the building structure could also have been conveniently truncated at the level of the cleavage line 40–42. One or more entry ways such as entryway 50 may be provided, by omitting a partial pyramid as shown, or a triangular panel. Windows can also be inserted, although this type of modification introduces complications not inherent in the arrangement already described.

It should be appreciated that the entire building structure shown in FIG. 10 has been formed from the triangular sections of FIGS. 2 and 5 and similar one half dimension sections for reinforcement. Because the pyramid wall elements weigh no more than 300 pounds it is practical to erect the building structure without requiring the use of elaborate cranes or the like. At most, methods of mechanical advantage that have been used for hundreds of years may be used if needed. No additional reinforcing members beyond the interior reinforcing pyramids are necessary for the FIG. 10 building structure.

Figure 11:
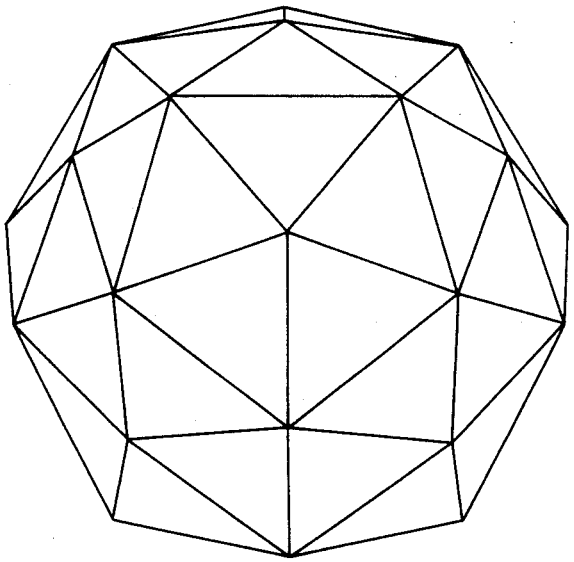
FIG. 11 shows a dodecahedron building structure having the pyramids of FIG. 8 as wall elements.

Referring now to FIG. 11, a dodecahedron has been modified by using the pentagonal pyramids of this invention in lieu of the plane pentagons on all surfaces except the base.

Figure 12:
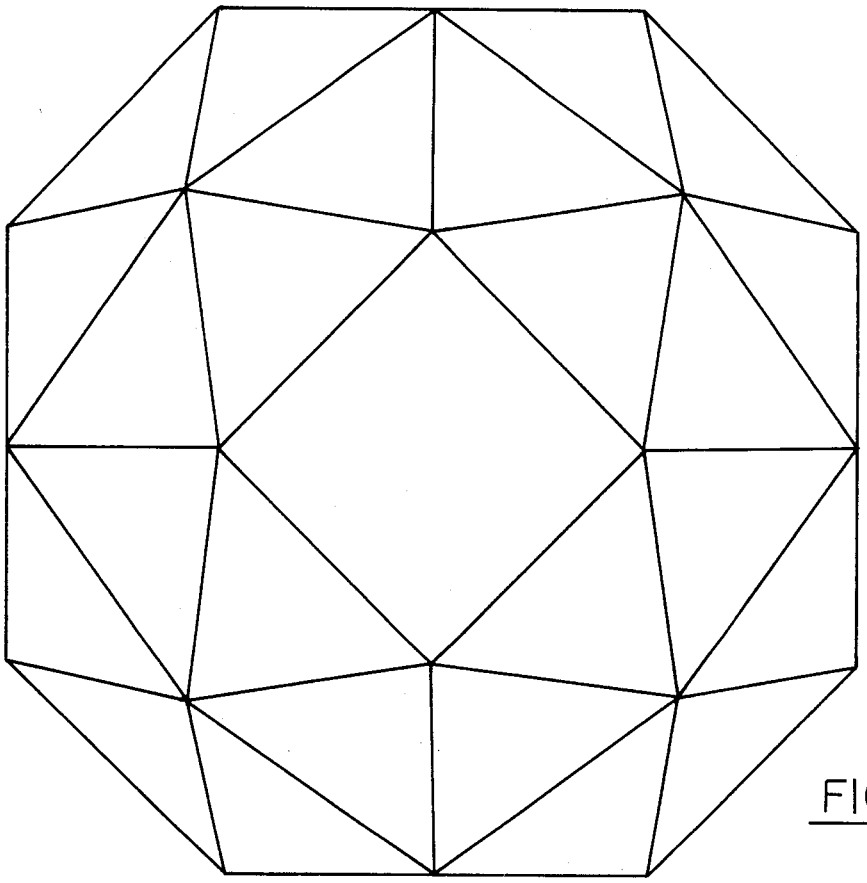
FIG. 12 shows another building structure having the pyramids of FIG. 6 as wall elements.

FIG. 12 illustrates the results of the same type of modification to the semiregular polyhedron having hexagons and squares as its wall elements. In this case the hexagonal pyramids of this invention have been substituted as wall elements in lieu of the plane hexagons.

Figure 13:
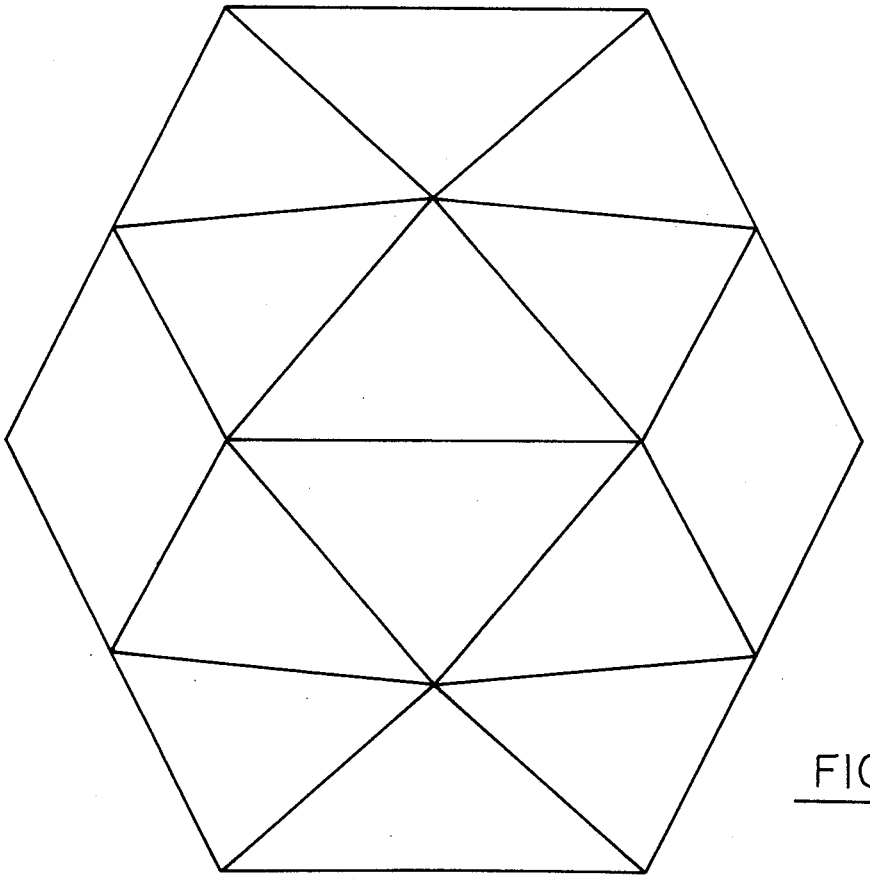
FIG. 13 is another view of the building structure of FIG. 12.

FIG. 13 illustrates the building structure of FIG. 12 rotated forty five degrees.

As is customary when using plywood for exterior structures, attention must be paid to proper sealing of joints and untreated plywood should receive a coating of paint or the like to protect it. Conventional techniques and materials are contemplated for these purposes.

Although a building structure in accordance with the invention has been illustrated and described, it will be evident that changes and modifications may be made without departing from the spirit of the invention and the scope of the appended claims.

I claim:

1. A frameless building structure comprising:

a plurality of right hexagonal pyramids;

at least one right pentagonal pyramid;

each of said hexagonal pyramids having six lateral sides formed of two right triangles;

each right triangle of said hexagonal pyramid side produced by cutting a rectangular panel diagonally;

each of said pentagonal pyramids having five lateral sides formed of two right triangles; and each right triangle of said pentagonal pyramid side having a base equal to the base of each of said right triangles of said hexagonal pyramid side and a hypotenuse equal to the height of each of said right triangles of said hexagonal pyramid side; and each of said pyramid wall elements has an interior reinforcement pyramid.

2. A frameless building structure in accordance with claim 1 wherein:

each of said interior reinforcement pyramids has length dimensions of one-half those of the pyramid wall element it reinforces.

3. In a building structure having its basis in a polyhedron having a plurality of polygonal wall elements of at least five sides, a frameless building structure comprising:

a right pyramid of equal triangular sides, and a base congruent with a polygon wall element of at least five sides of said polyhedron, said right pyramid substituted for said polygon wall element of said polyhedron;

each of said triangular sides of said right pyramid fabricated from two right triangular sections;

each of the right triangular sections of each right pyramid having five sides formed from a rectangular panel having a length two times its width so as to have a base equal to the width of said rectangular panel and a hypotenuse equal to the length of said panel;

each of the right triangular sections of each right pyramid having six sides formed from a rectangular panel having a length two times its width so as to have a base equal to the width of said rectangular panel and an altitude equal to the length of said panel; and each right pyramid has an interior reinforcement right pyramid.

4. The building structure of claim 3 wherein:

each of said interior reinforcement pyramids has length dimensions of one-half those of the pyramid it reinforces.

5. In a building structure having its basis in a polyhedron having a plurality of wall areas configured as regular polygons of at least five sides, the improvement comprising:

forming wall elements for said wall areas as frameless regular pyramids;

each of said frameless regular pyramids having triangular sides formed from two right triangular sections;

each regular pyramid has an interior reinforcement regular pyramid.

6. The building structure of claim 5 wherein:

each of said interior reinforcement pyramids has length dimensions equal to one-half of the pyramid it reinforces.

* * * * *